United States Patent [19]

Thebeau

[11] Patent Number: 4,898,102

[45] Date of Patent: Feb. 6, 1990

[54] LOAD CARRYING SKID ASSEMBLY

[76] Inventor: Donald W. Thebeau, 12 Holly Hill Dr., Freedom, Pa. 15042

[21] Appl. No.: 377,557

[22] Filed: Jul. 10, 1989

[51] Int. Cl.[4] ..... B65D 19/31

[52] U.S. Cl. ..... 108/56.1; 108/55.3

[58] Field of Search ..... 108/51.1, 56.1, 56.3, 108/57.1, 52.1, 51.3, 55.1; 248/346

[56] References Cited

U.S. PATENT DOCUMENTS

| | | | |
|---|---|---|---|
| 2,570,757 | 10/1951 | Bowman et al. | 108/52.1 X |
| 3,927,624 | 12/1975 | Roberts | 108/56.1 X |
| 4,382,733 | 5/1983 | Rodgers | 108/55.3 X |
| 4,397,246 | 8/1983 | Ishida et al. | 108/55.3 |
| 4,841,880 | 6/1989 | Ferguson | 108/56.1 X |

*Primary Examiner*—Peter A. Aschenbrenner

*Attorney, Agent, or Firm*—Paul Bogdon

[57] ABSTRACT

A load carrying skid assembly, particularly constructed for supporting coils of sheet metal or sheet paper, barrels and the like, is disclosed. The skid includes spaced parallel elongated base members having oppositely formed notches at obtuse angles inclined toward each other. Elongated load bearing members having slots complimentary in shape and size with the notches of the base members are interconnected with the base members with the slots and notches in engagement with each other. The interconnected load bearing and base members form a matrix for receiving and supporting a load. The base members are provided longitudinally extending grooves on their respective lower surfaces for receiving metal straps wrapped around the load to hold it on the skid.

6 Claims, 1 Drawing Sheet

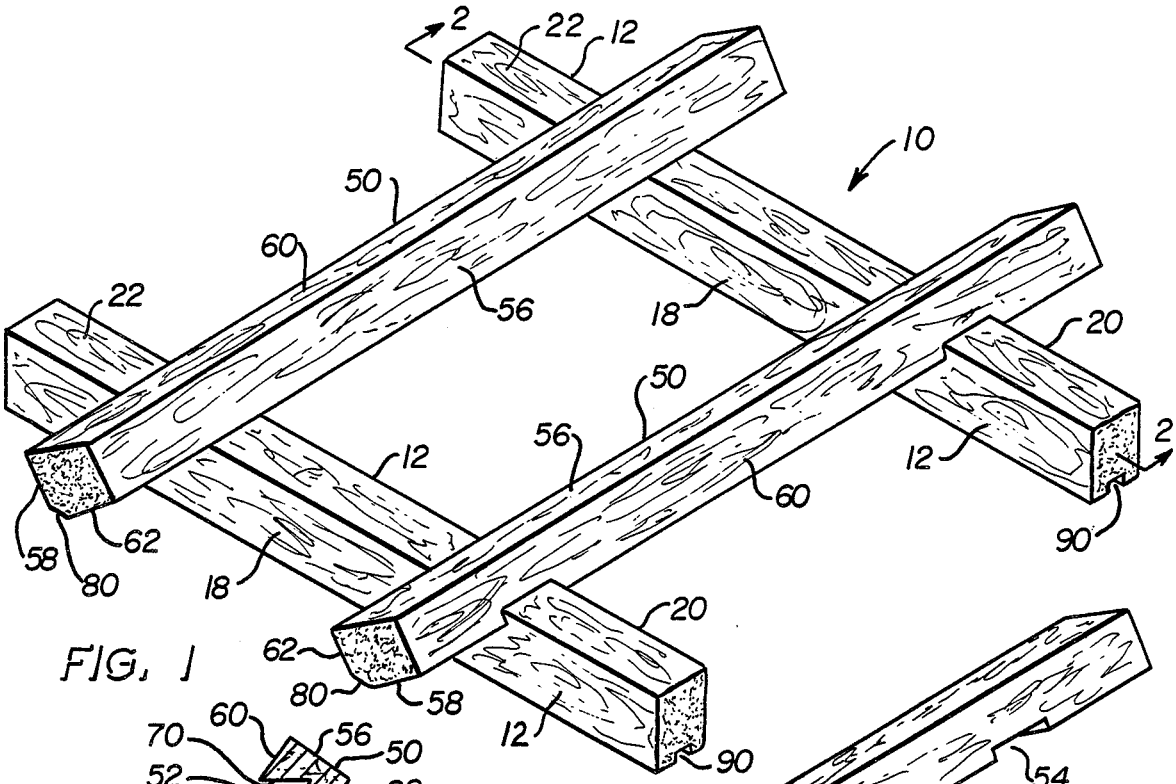
FIG. 1
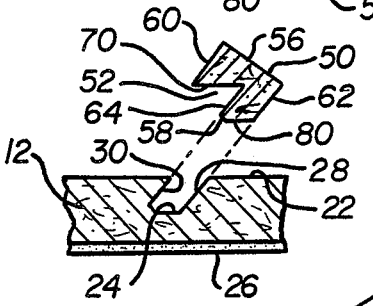
FIG. 5
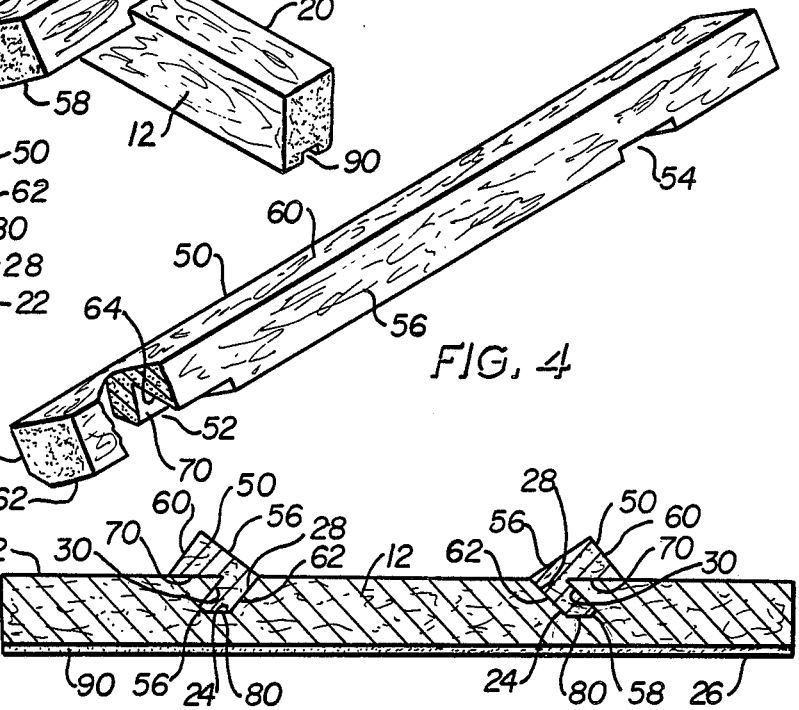
FIG. 4
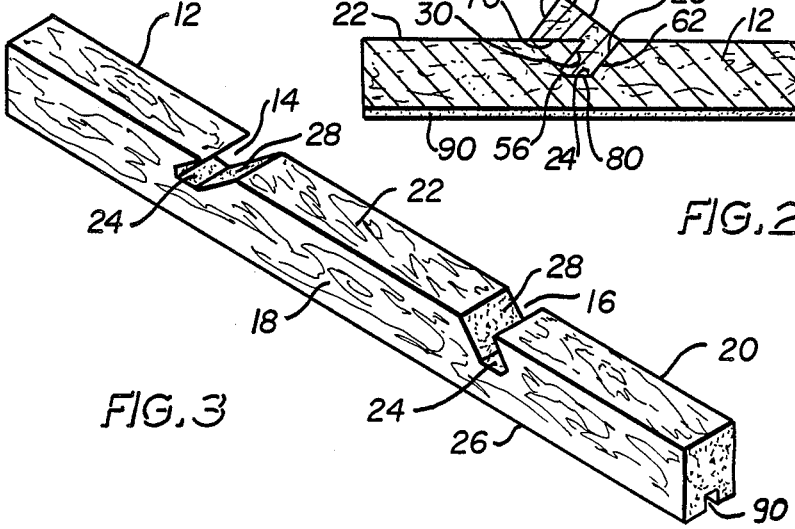
FIG. 3
FIG. 2

LOAD CARRYING SKID ASSEMBLY

BACKGROUND OF THE INVENTION

This invention relates to skid or pallet assemblies particularly for use in supporting coils of metal, such as steel or aluminim, or other items having cylindrical outlines such as coils of paper, barrels, large diameter piping, and the like.

When shipping coils of steel or other similarly shaped loads, it is common to secure the coils on wooden skids. In making such skids of this type it has been customary to form them from pieces of wood nailed together to form a matrix which accomodates the cylindrical configuration of the load. Upwards of ten or more pieces of wood would be required. The wood used was of a high grade hard nature to avoid splitting by the many nails required to be driven into position, and also for providing the requisite strength for supporting the heavy loads. Under these circumstances, the skids are expensive both with respect to the materials making up the skids, and also with respect to the manpower time needed for assembling the structure.

In addition to the expense of the heretofore known skids, it has been found that they are routinely discarded after single uses because of broken parts or for the reason that the receiver of the shipped package does not desire to return them to the shipper or to store the skids because of their bulkiness. The known skids are awkward to store and require an inordinately large area for the storage of large numbers of skids.

This invention provides a skid assembly which overcomes the drawbacks inherent in skids heretofore used. My present skid is formed of a minimum of four pieces of hard wood lumber interconnected without nails or any other securing hardware to form the needed matrix for supporting coils of steel, or other cylindrical outlined loads. Two base members of identical shape are interconnected with two identical load bearing members. The members forming the skid are simply formed and efficiently stored or shipped. In the event one of the members is broken or damaged it is conveniently replaced with a like member. The skid may be assembled simply and quickly, literally in seconds.

SUMMARY OF THE INVENTION

My load carrying skid assembly, in its preferred form, comprises: at least a pair of spaced elongated base members, each having a generally rectangular cross-section, and a longitudinal load bearing upper face and an opposite longitudinal surface engaging lower face, and longitudinal side faces; each base member defining oppositely disposed first and second notches inclined at obtuse angles toward each other and toward the transverse centerline of the base member, each notch extending through the side faces of the base member, each notch also extending from an open upper end at the upper face of the base member to a closed lower end intermediate the upper and lower faces of said base member, each notch having inner and outer walls connected at their bottom ends by the lower end; and at least a pair of spaced elongated load engaging members each having a generally rectangular cross-section removably interconnected with and extending laterally across the base members; each of the load engaging members having a longitudinal load engaging first side, an opposite second side, a longitudinal third side, and an opposite fourth side; and the load engaging members mated in the first and second notches of the base members to dispose the load engaging first sides of the load engaging members at obtuse angles extending away from each other and away from the transverse centerlines of the base members. The load bearing members may be provided with longitudinally spaced slots which ae complimentary in shape with and are disposed to snugly mate with the angular notches of the base members. The interconnection of the pair of load engaging members with the base members provides a skid assembly having a criss-crossed pattern with a trough being defined by the members for receiving and supporting a load. The coupling of the members to form the skid is achieved without the need of nails, staples, bolts, or any other securing means. Any load, such as a coil of sheet steel, supported by my skid assembly will apply a force on the load engaging sides of the load engaging members to urge the load engaging members into a locked relationship with the base members. The bottoms of the base members may be provided with longitudinally extending open grooves sized to receive metal straps for securing the load in place.

The base members and load engaging members may each be formed so that the respective members are identical, thereby requiring the manufacture of only two distinct members where using two of each are only needed for forming a four element skid assembly. The members are removable from each other since nailing is not necessary, and are efficiently and economically stored. In the event any one of the members forming my skid assembly is damaged it may be simply replaced to restore the skid. Various other advantages, details, and modifications of my present invention will become apparent as the following description of a present preferred embodiment proceeds.

DESCRIPTION OF THE DRAWINGS

In the accompanying drawings I show a certain present preferred embodiment of my invention in which:

FIG. 1 is a perspective view of my skid assembly;

FIG. 2 is a view looking along the line 2—2 of FIG. 1;

FIG. 3 is a perspective view of one of the base members forming part of the assembly of FIG. 1;

FIG. 4 is a perspective view of one of the load bearing members forming part of the assembly of FIG. 1; and FIG. 5 is a cross section view of a notch and a slot of a base member and a load bearing member respectively, enlarged and separated to show details of construction.

DESCRIPTION OF A PREFERRED EMBODIMENT

Referring now to the drawings there is shown a load carrying skid assembly 10 particularly suited for supporting loads having cylindrical outlines, such as coils of sheet steel, coils of paper, barrels, large diameter piping and the like. The skid assembly 10 has a criss-crossed pattern and includes a pair of identically shaped generally parallel elongated base members 12 shown having a generally rectangular cross-section. The shape of the base members 12 is not limited to a rectangular cross-section but may be of any other shape suitable for providing their function. Whenever the expression "rectangular cross-section" is applied herein it is to be construed to include any other suitable shape and not to be limited to the precise geometric definition. Each base member 12 is provided with identically shaped and sized first and second notches 14 and 16, respectively, spaced inwardly from the opposite ends of the base member. The notches 14 and 16 are inclined at obtuse angles toward each other and toward the transverse centerline of the base member 12. Each notch 14 and 16 extends through the longitudinal side faces 18 and 20, and extends from open upper ends at the upper face 22 of the base member 12 to a closed lower end 24 generally parallel to the upper face 22. The closed lower ends 24 of the notches 14 and 16 are disposed about midway between the upper face 22 and the surface engaging lower face 26 of the base member 12. Each noch 14 and 16 defines an inner wall 28 toward the transverse centerline of the base member 12 and an opposite and parallel outer wall 30.

The criss-crossed pattern of the skid assembly 10 is completed by the interconnections of a pair of identically shaped and sized parallel elongated load engaging members 50 with the base members 12. Each load engaging member 50 and base member 12 may be formed of a suitable hardwood, but may also be formed of a metal or plastic material. Each load engaging member 50 has a basic rectangular cross-section but as illustrated has a corner cut off as will be described hereinafter. The load engaging members 50 are each provided with a pair of identically shaped, longitudinally spaced slots 52 and 54, respectively, complimentary in shape to the notches 14 and 16 and sized and positioned on the load engaging members 50 to snugly mate with the notches 14 and 16. Each load engaging member 50 has a longitudinal first or load engaging side 56, an opposite generally second side 58, a third side 60 and an opposite generally parallel, fourth side 62. The slots 52 and 54 each have a generally V-shaped cross-section with an open end extending from a lower portion of the third side 60 of the load engaging member 50 and from a portion of the adjacent second side 58. The V-shaped slots 52 and 54 extend to a closed ended longitudinally extending line. Each slot 52 and 54 defines a first surface 64 extending from the second side 58 of the load engaging member 50 to the closed end of the slot. The first surfaces 64 of the slots 52 and 54 are generally parallel to the fourth side 62 of the load engaging member 50. In addition the first surfaces 64 of the slots 52 and 54 are at obtuse angles to the second side 58 generally the same as the obtuse angle made by the inner and outer walls 28 and 30 of the notches 14 and 16 with the upper faces 22 of the base members 12. Each slot 52 and 54 defines a second surface 70 extending from the third side 60 of the load engaging member 50 at an obtuse angle to the third side 60. The obtuse angle of the second surface 70 is generally the same as the angle which the inner and outer walls 28 and 30 of the notches 14 and 16 make with the upper faces 22 of the base members 12.

With the notches 14 and 16 and the slots 52 and 54 formed in the manner described, and the longitudinal widths of the slots being slightly greater in dimension than the longitudinal widths of the notches, the load engaging members 50 are interconnected with the base members 12 such that the slots 52 and 54 will mate with the notches 14 and 16 as shown in the drawings. A flattened corner section 80 is provided between the surfaces 58 and 62 of each load engaging member 50. The mating of the load engaging members 50 with the base members 12 will result in the second surfaces 70 of the slots 52 and 54 abutting a portion of the upper faces 22 of the base members 12; the first surfaces 64 of the slots 52 and 54 abutting the outer walls 30 of the notches 14 and 16 of the base members 12; the portion of the fourth side 62 of the load engaging members 50 opposite the slots 52 and 54 abutting the inner walls 28 of the notches 14 and 16 of the base members 12. Additionally, the load bearing first side 56 of the parallel load engaging members 50 will be inclined away from each other at obtuse angles to the upper surface 22 of the base members 12. The corner sections 80 of the load engaging members 50 opposite the slots 52 and 54 will abut the lower ends 24 of the notches 14 and 16 of the base members 12. As shown, the entireties of the corner sections 80 of the load engaging members 50 extend, the full length of the load engaging members 50 and when the load engaging members 50 are interconnected with the base members 12, the corner sections 80 of the load engaging members 50 will be generally parallel with the upper faces 22 and surface engaging faces 26 of the base members 12. The corner sections 80 of the load engaging members 50 provide surfaces for engagement of the skid assembly 10 by the flattened forks of a fork lift truck.

With the skid assembly 10 formed by the interconnection of the pairs of load engaging members 50 and base members 12, a trough-like pattern is formed for receiving a load. The weight of the load on the skid assembly 10 will urge a force on the load engaging members 50 to urge the load engaging members into locked engagement with the base members 10. With a load in place on the skid assembly 10, the load may be secured to the skid assembly by metal wrapping straps, not shown, reeved around the load and in longitudinal grooves 90 formed centrally on the surface engaging faces 26 of the base members 12.

My skid assembly 10 does not require that its members be secured by mailing or otherwise. Also, great economy of wood use is realized since only two parts are needed to be formed because pairs of each are all that is needed in forming the skid assembly. The individual parts are efficiently and easily stored in anticipation of their assembly. A broken part may be simply replaced to form a new skid assembly, rather than discarding the skid. It should be clearly understood that the skid assembly may be put together in seconds by unskilled workers. It should also be recognized how all of the new results and advantages of my invention, as described in the introductory part of this specification, are achieved.

While I have shown and described a present preferred embodiment of my invention, it is to be distinctly understood that the invention is not limited thereto but may be otherwise embodied within the scope of the following claims.

I claim:

1. A load carrying skid assembly comprising:

at least a pair of spaced elongated base members, each having a generally rectangular transverse cross-section, and a longitudinal load bearing upper face and an opposite longitudinal surface engaging lower face, and longitudinal side faces; each base member defining oppositely disposed first and second notches inclined at obtuse angles toward each other and toward the transverse centerline of the base member, each notch extending through the side faces of the base member, each notch also extending from an open upper end at said upper face of said base member to a closed lower end intermediate said upper and lower faces of said base member, each notch having inner and outer walls connected at their bottom ends by said lower end; and at least a pair of spaced elongated load engaging members each having a generally rectangular transverse cross-section removably interconnected with and extending laterally across said base members; each of said load engaging members having a longitudinal load engaging first side, an opposite second side, a longitudinal third side, and an opposite fourth side; said load engaging members mated in said first and second notches of said base members to dispose said load engaging first sides at obtuse angles extending away from each other and away from the transverse centerlines of said base members.

2. A load carrying skid assembly as set forth in claim 1 wherein each of said load engaging members defining a pair of longitudinally spaced slots complimentary in shape to snugly mate with said first and second notches of the spaced pair of said base members to dispose said load engaging first side of said load engaging members at obtuse angles extending away from each other and away from the transverse centerlines of said base members.

3. A load carrying skid assembly as set forth in claim 1 wherein said base members are spaced generally parallel to each other; and said load engaging members are spaced parallel to each other.

4. A load carrying skid assembly as set forth in claim 1 wherein each of said base members defines a longitudinally extending open groove on said surface engaging lower face shaped and sized to receive a metal strap or the like for securing a load in place.

5. A load carrying skid assembly as set forth in claim 2 wherein each of said slots in a said load engaging member has a generally V-shaped cross-section with an open end extending from a portion of said second side and a portion of said third side to a closed ended longitudinally extending line; each slot defining a first surface extending from said second side at an obtuse angle to said second side, the obtuse angle of said first surface being generally the same as the angle said outer side of a said notch makes with said upper face of a said base member; said first surface of a said slot being generally parallel with a said fourth side of said load bearing member; each slot defining a second surface extending from said third side at an obtuse angle to said third side, the obtuse angle of said second surface being generally the same as the angle said inner wall of a said notch makes with said upper face of a said base member; each of said slots and each of said notches being constructed and arranged such that said base members and said load engaging members will interconnect by the engagement of said slots and said notches to form a cross matrix to have said load engaging first sides of said load engaging members facing each other at obtuse angles with the portion of a said fourth side of a said load engaging member opposite a said slot abutting a said inner wall of a said notch and a said second surface of a said slot engaging a portion of a said upper surface of a said base member, and a said first surface of a said slot abutting a said outer wall of a said notch.

6. A load carrying skid assembly as set forth in claim 5 wherein said lower end of a said notch is generally parallel with a said load bearing upper face of a said base member; wherein said fourth side of a said load engaging member is generally parallel with a said second side of a said slot; whereby when said load engaging members are interconnected with said base members said fourth sides of said load engaging member opposite said slots will engage said lower ends of said notches.

* * * * *